US005996449A

United States Patent [19]

Hsieh

[11] Patent Number: 5,996,449

[45] Date of Patent: Dec. 7, 1999

[54] OPEN END WRENCH PRACTICAL FOR TURNING NORMAL AND WORN-OUT BOLTS AND NUTS OF DIFFERENT SPECIFICATIONS

[76] Inventor: Chih-Ching Hsieh, No. 64, Lane 107, Liang Tsun Rd., Fong Yuan City, Taichung Hsien, Taiwan

[21] Appl. No.: 09/012,650

[22] Filed: Jan. 23, 1998

[51] Int. Cl.[6] ..... B25B 13/00

[52] U.S. Cl. ..... 81/186; 81/119

[58] Field of Search ..... 81/119, 120, 186

[56] References Cited

U.S. PATENT DOCUMENTS

| | | | |
|---|---|---|---|
| 486,764 | 11/1892 | Carpenter | 81/186 |
| 825,401 | 7/1906 | Merckens | 81/120 |
| 1,624,508 | 4/1927 | Reilly | 81/186 |
| 5,860,339 | 1/1999 | Mikic et al. | 81/119 |

FOREIGN PATENT DOCUMENTS

| | | | |
|---|---|---|---|
| 623208 | 3/1927 | France | 81/119 |
| 76832 | 2/1918 | Switzerland | 81/119 |
| 217710 | 6/1924 | United Kingdom | 81/119 |

*Primary Examiner*—David A. Scherbel

*Assistant Examiner*—Joni B. Danganan

*Attorney, Agent, or Firm*—Varndell & Varndell, PLLC

[57] ABSTRACT

An open end wrench having a mouth defined between two jaws and a nest thereof, a flat raised portion and a longitudinal series of teeth respectively raised from the two jaws inside the mouth. The longitudinal series of teeth including five teeth. The length of the flat raised portion being equal to the distance between the mid point of the first tooth of the longitudinal series of teeth and the midpoint of the last tooth thereof. The total length of the longitudinal series of teeth being equal to 0.67 of the width of the mouth. The distance from the remote end of the longitudinal series of teeth to the nest being 0.91 of the width of the mouth, and the first tooth of the longitudinal series of teeth and the second tooth thereof having a respective smoothly curved peak for grasping normal square head bolts and square nuts and normal hexagon head bolts and hexagon nuts. The third tooth and the fourth tooth of the longitudinal series of teeth being pointed teeth, and the distance between the mid point of the flat raised portion and the third tooth of the longitudinal series of teeth being equal to the width of the mouth. The fifth tooth of the longitudinal series of teeth being for turning hexagon head bolts, hexagon nuts, square head bolts and sqaure nuts in the reversed direction.

1 Claim, 13 Drawing Sheets

OPEN END WRENCH PRACTICAL FOR TURNING NORMAL AND WORN-OUT BOLTS AND NUTS OF DIFFERENT SPECIFICATIONS

BACKGROUND AND SUMMARY OF THE INVENTION

The present invention relates to open end wrenches, and more particularly to an improved structure of open end wrench which is practial for grasping and turning normal bolts and nuts of different specifications as well as worn-out bolts and nuts of different specifications.

An open end wrench is handy tool intensively used for grasping and turning bolts and nuts. A variety of open end wrenches have been disclosed having teeth, raised portions or rough grasping faces at the jaws for grasping and turning normal bolts and nuts as well as worn-out bolts and nuts. Exemplars of conventional open end wrenches are shown in FIGS. from 1 to 13. The open end wrench shown in FIGS. 1, 2, and 3 has two flat raised portions at the jaws. This structure of open end wrench is functional for turning normal bolts and nuts as well as slightly worn-out bolts and nuts. However, it can not positively grasp and turn excessively worn-out bolts and nuts. FIGS. 4, 5, 7,8, 9, 10 and 11 show other different designs. These designs can grasp and turn bolts and nuts of different sizes. However, these designs can not positively grasp and turn excessively worn-out bolts and nuts. FIG. 6 shows another design of open end wrench which is similar to the open end wrench shown in FIGS. 1 to 3. FIG. 12 shows an open end wrench having rough faces at the jaws. FIG. 13 shows an open end wrench having teeth at the jaws. The open end wrenches shown in FIGS. 12 and 13 can positively grasp and turn normal bolts and nuts, however they tend to slip when turning an excessively worn-out bolt or nut.

It is one object of the present invention to provide an open end wrench which is practical for grasping and turning hexagon head bolts and hexagon nuts as well as square head bolts and square nuts. It is another object of the present invention to provide an open end wrench which is practical for grasping and turning normal bolts and nuts of different specifications as well as worn-out bolts and nuts of different specifications. According to the present invention, the open end wrench comprises a mouth defined between two jaws and nest thereof, a flat raised portion and a longitudinal series of teeth respectively raised from the two jaws inside the mouth, the longitudinal series of teeth including an odd number of teeth, the length of the flat raised portion being equal to the distance between the mid point of the first tooth of the longitudinal series of teeth and the midpoint of the last tooth thereof, the total length of the longitudinal series of teeth being equal to 0.67 of the width of the mouth, the distance from the remote end of the longitudinal series of teeth to the nest being 0.91 of the width of the mouth, the first tooth of the longitudinal series of teeth and the second tooth thereof having a respective smoothly curved peak for grasping normal square head bolts and square nuts and normal hexagon head bolts and hexagon nuts, the third tooth and the fourth tooth of the longitudinal series of teeth being pointed teeth, the distance between the mid point of the flat raised portion and the third tooth of the longitudinal series of teeth being equal to the width of the mouth, the fifth tooth of the longitudinal series of teeth being for turning hexagon head bolts, hexagon nuts, square head bots and square nuts in the reversed direction.

DETAILED DESCRIPTION OF THE PREFERRED EMBODIMENT

An open end of an open end wrench according to the present invention is similar to regular open end wrenches, comprising two jaws, a nest connected between the jaws, and a mouth defined within the jaws and the nest and adapted for grasping and turning bolts, nuts, etc.

Figure 1:
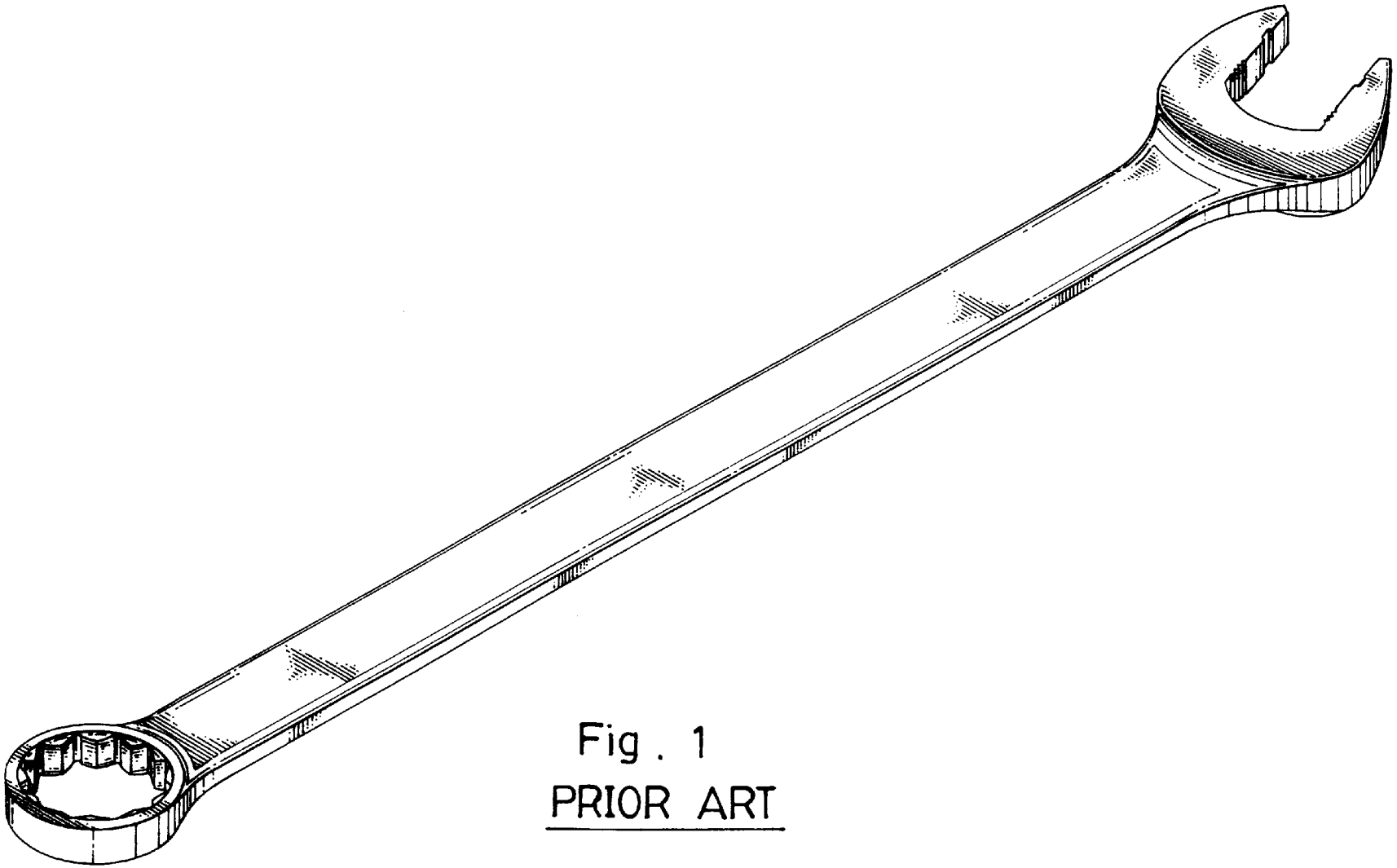
Fig. 1 PRIOR ART
FIG. 1 shows a combination wrench according to the prior art.
Figure 2:
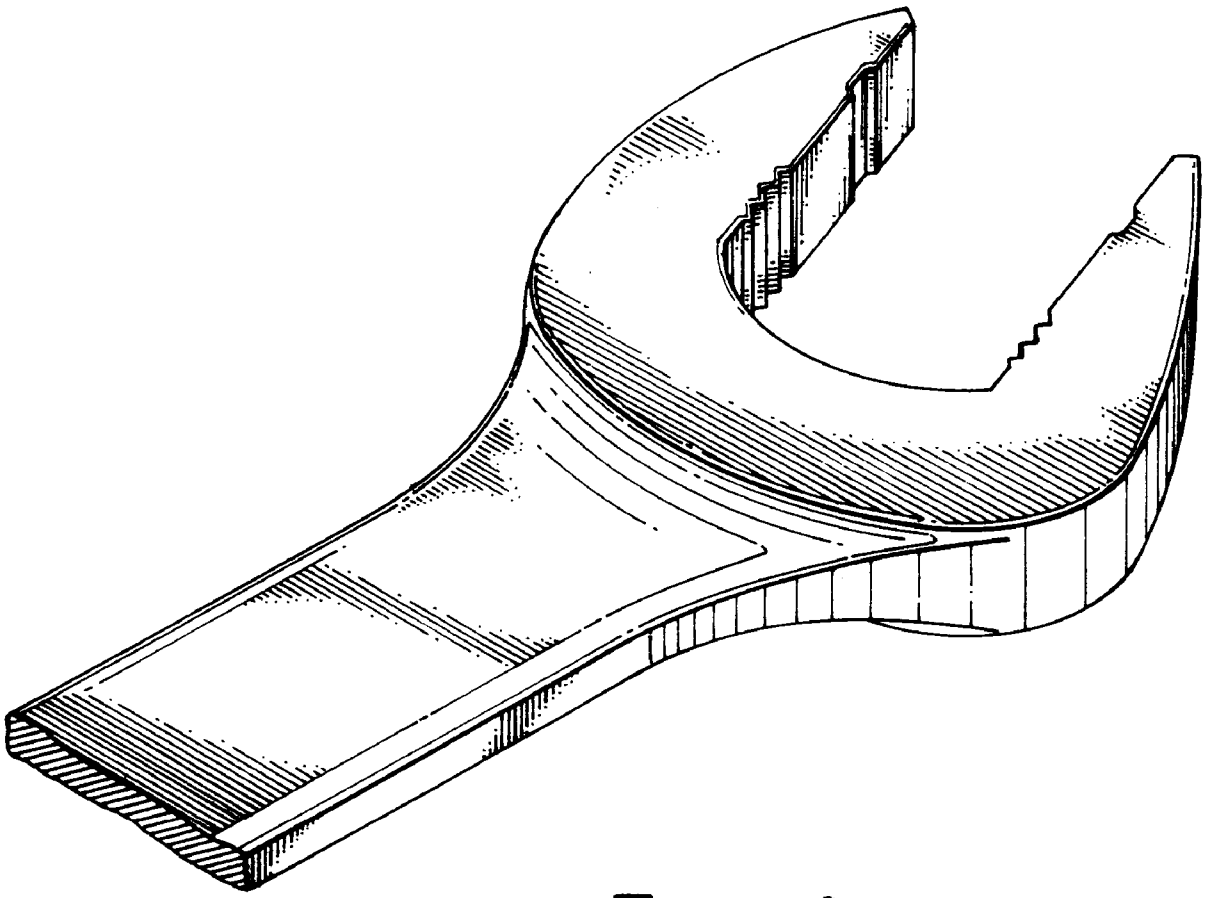
Fig. 2 PRIOR ART
FIG. 2 is an enlarged view of the open end of the combination wrench shown in FIG. 1.
Figure 4:
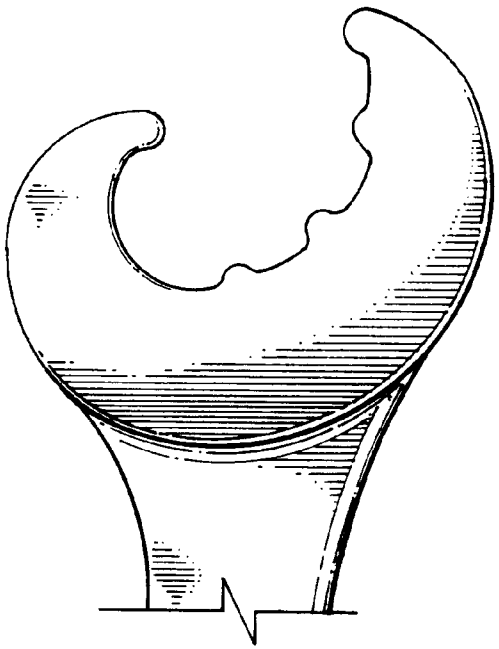
Fig. 4 PRIOR ART
FIG. 4 shows another structure of open end wrench according to the prior art.
Figure 3:
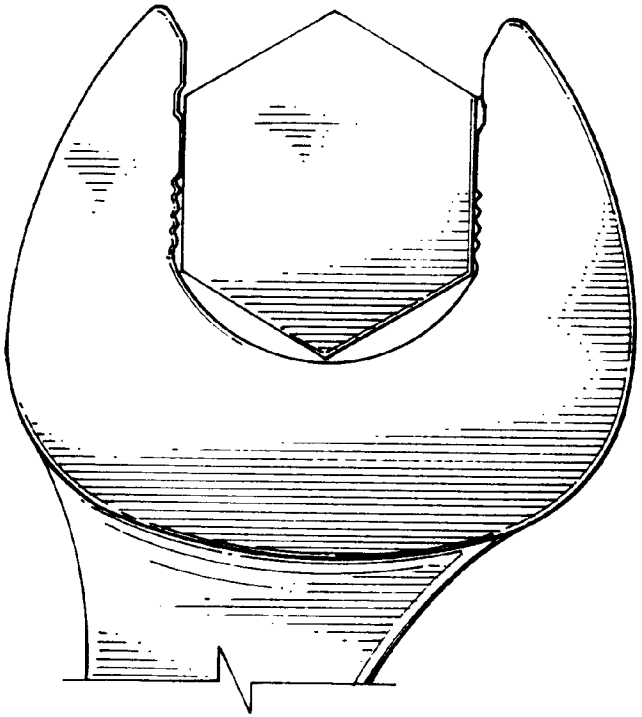
Fig. 3 PRIOR ART
FIG. 3 shows an application example of the open end of the combination wrench shown in FIG. 1.
Figure 6:
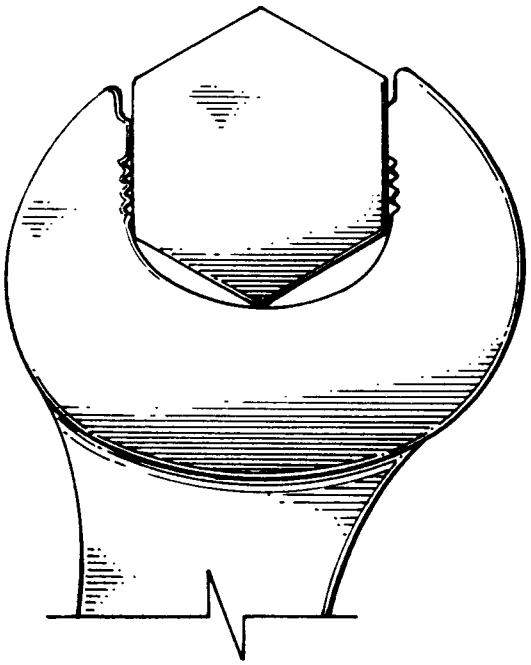
Fig. 6 PRIOR ART
FIG. 6 shows still another structure of open end wrench according to the prior art.
Figure 5:
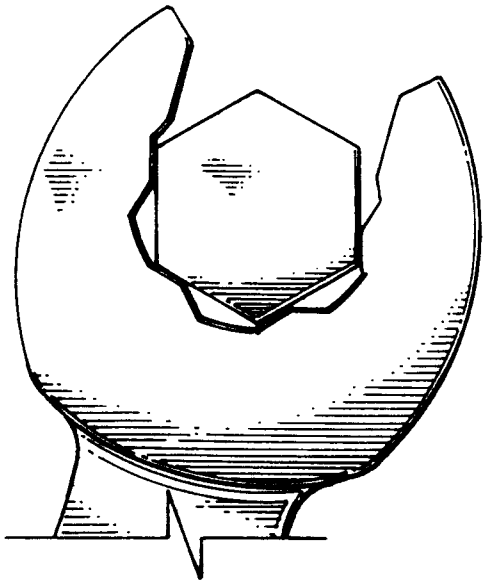
Fig. 5 PRIOR ART
FIG. 5 shows still another structure of open end wrench according to the prior art.
Figure 8:
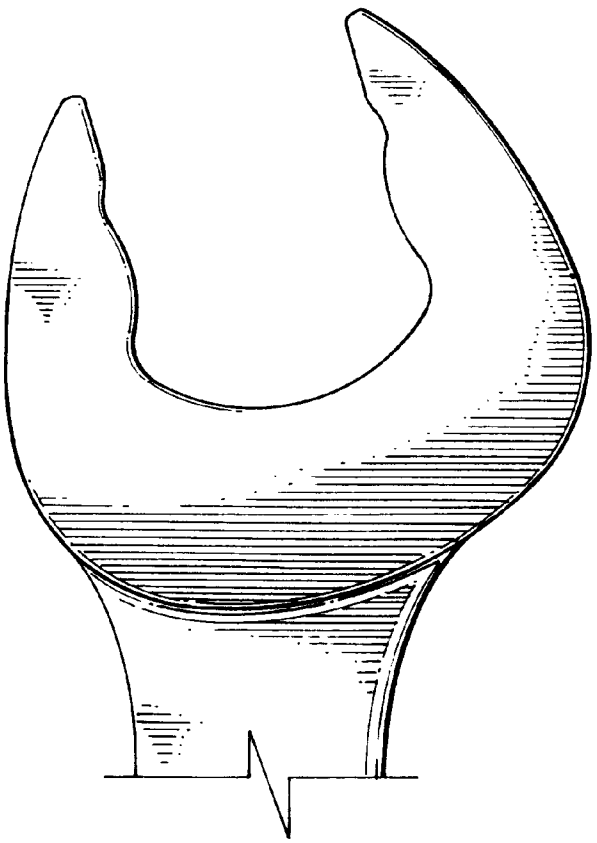
Fig. 8 PRIOR ART
FIG. 8 shows still another structure of open end wrench according to the prior art.
Figure 7:
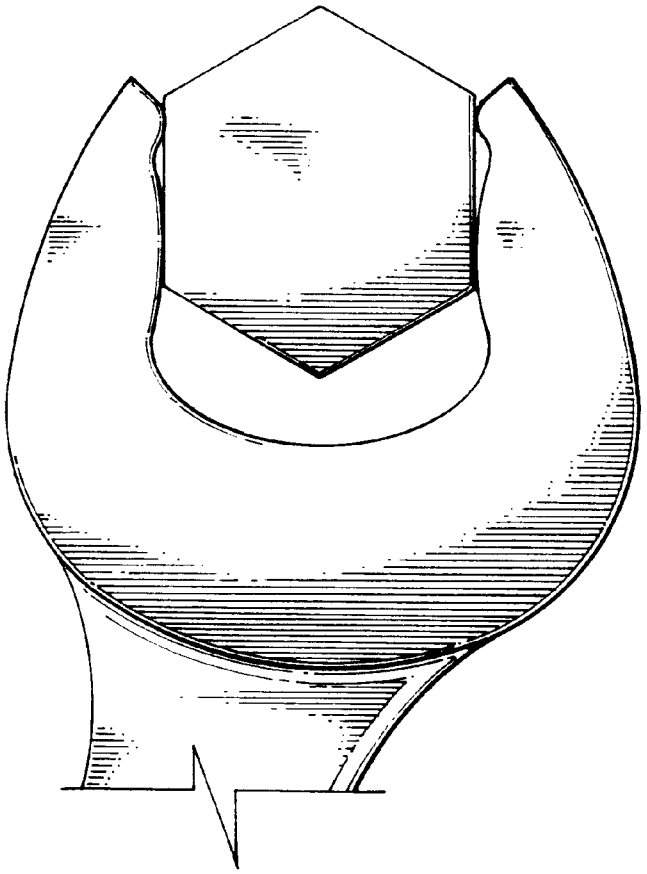
Fig. 7 PRIOR ART
FIG. 7 shows still another structure of open end wrench according to the prior art.
Figure 10:
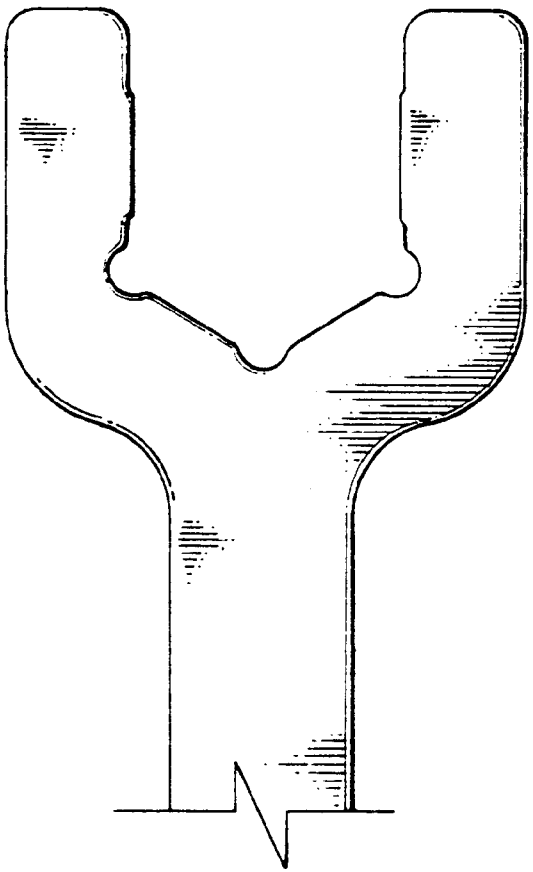
Fig. 10 PRIOR ART
FIG. 10 shows still another structure of open end wrench according to the prior art.
Figure 9:
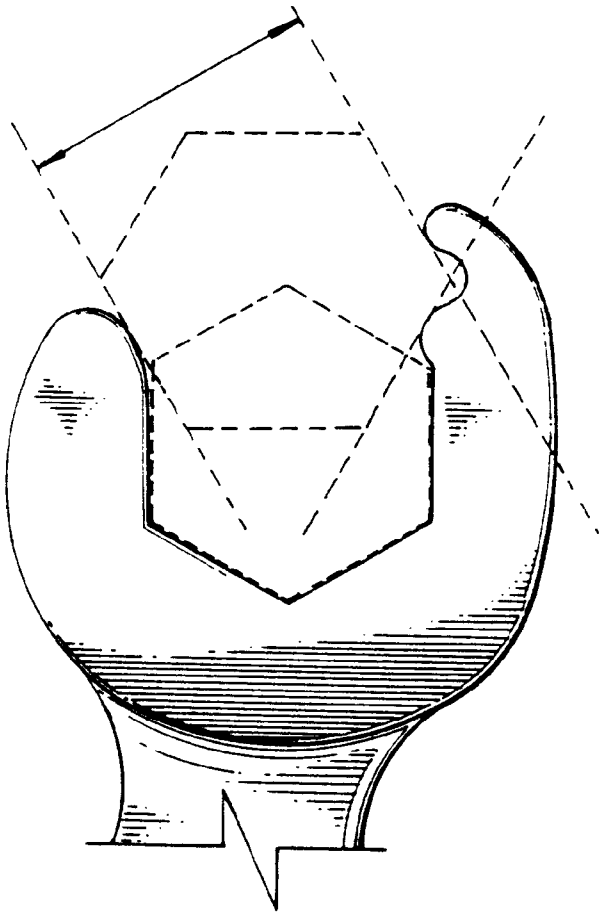
Fig. 9 PRIOR ART
FIG. 9 shows still another structure of open end wrench designed for turning bolts and nuts of different specifications according to the prior art.
Figure 11:
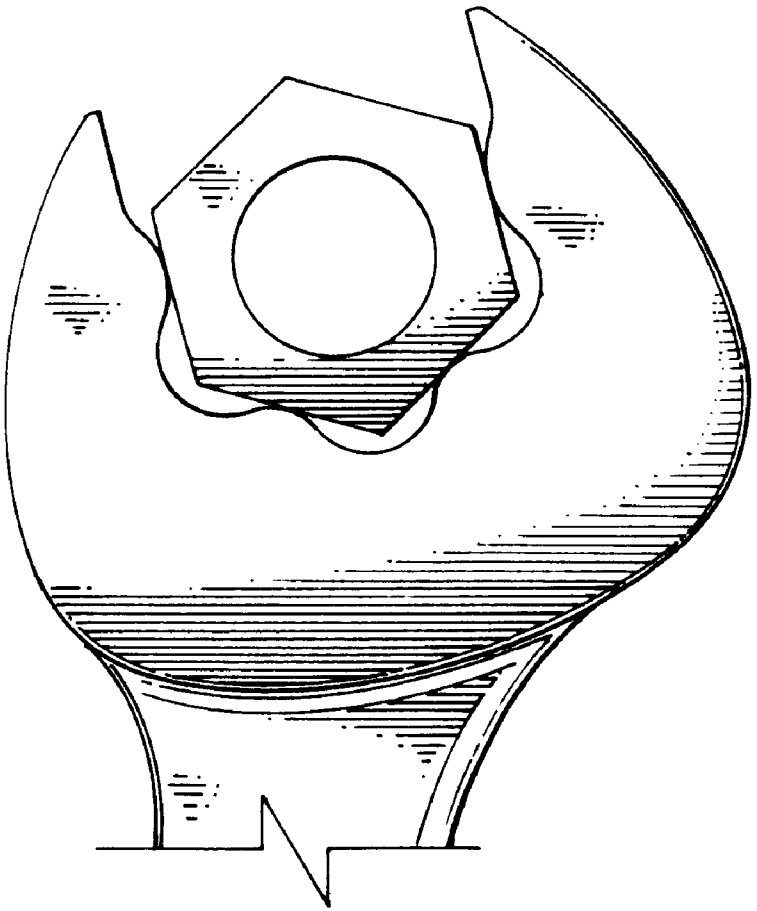
Fig. 11 PRIOR ART
FIG. 11 shows still another structure of open end wrench designed for turning bolts and nuts of different specifications according to the prior art.
Figure 13:
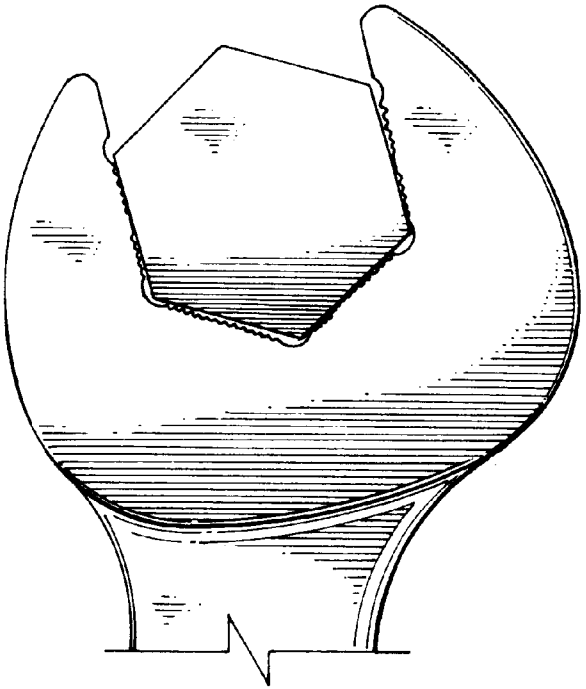
Fig. 13 PRIOR ART
FIG. 13 shows still another structure of open end wrench according to the prior art where the jaws have a respective longitudinal row of teeth at an inner side for grasping.
Figure 12:
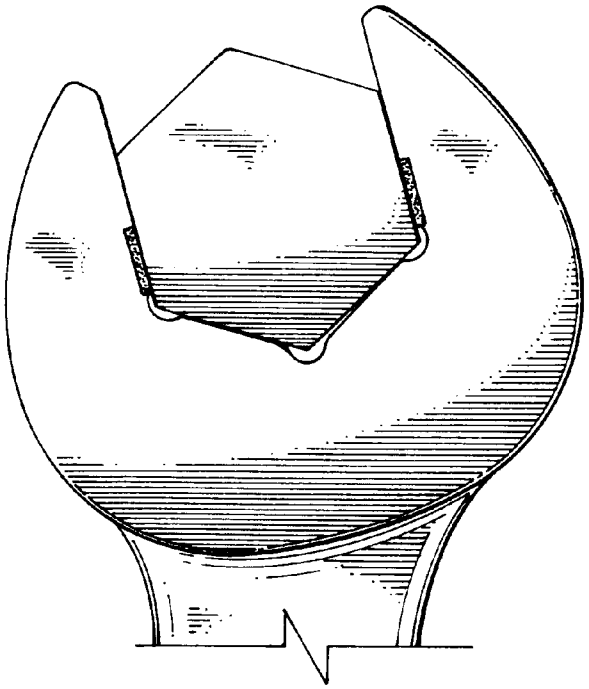
Fig. 12 PRIOR ART
FIG. 12 shows still another structure of open end wrench according to the prior art where the jaws have a respective rough grasping face at an inner side.
Figure 14:
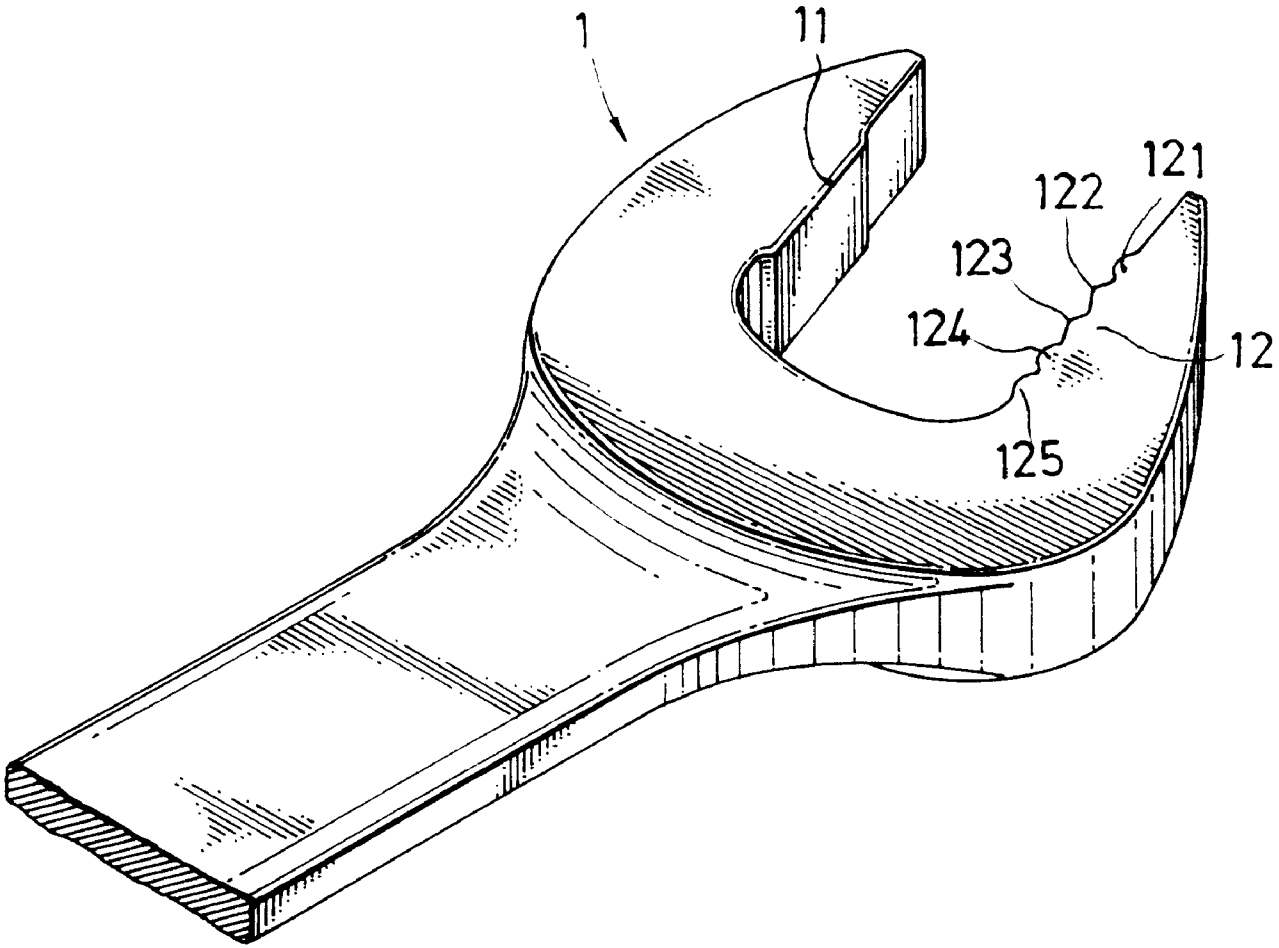
FIG. 14 is a perspective view of an open end wrench according to the present invention.
Figure 16:
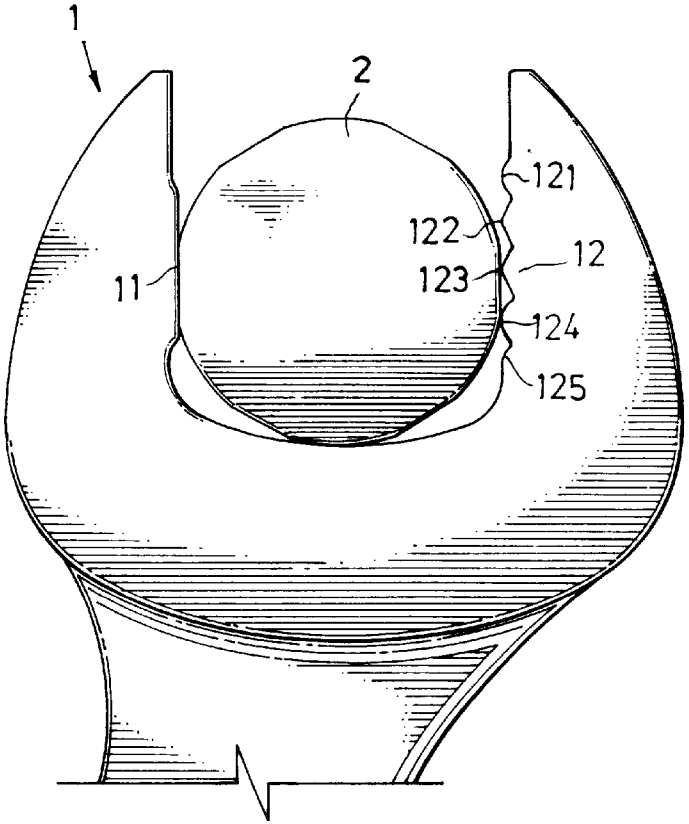
FIG. 16 shows the open end wrench grasped on a worn-out bolt according to the present invention.
Figure 15:
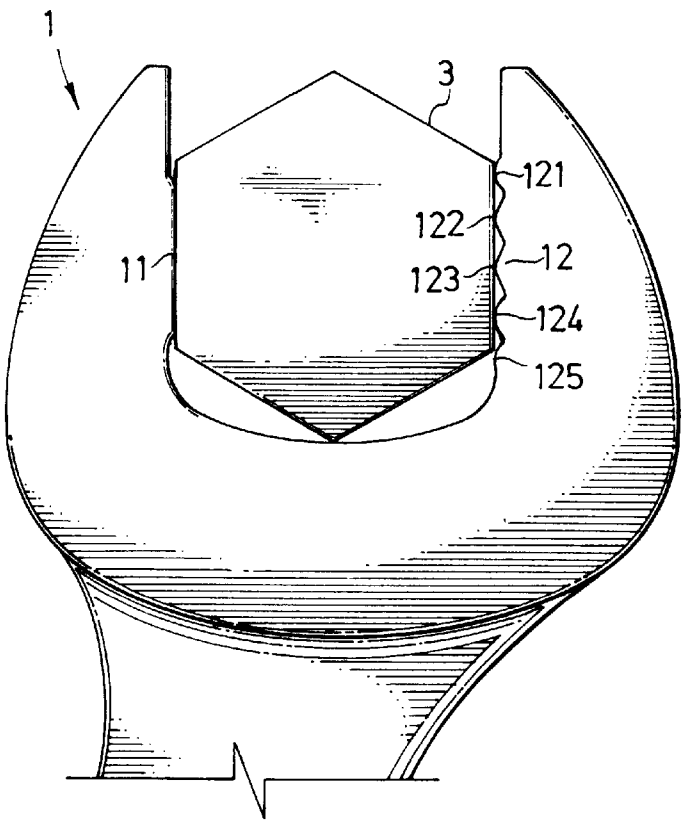
FIG. 15 shows the open end wrench grasped on a normal hexagon head bolt according to the present invention.
Figure 17:
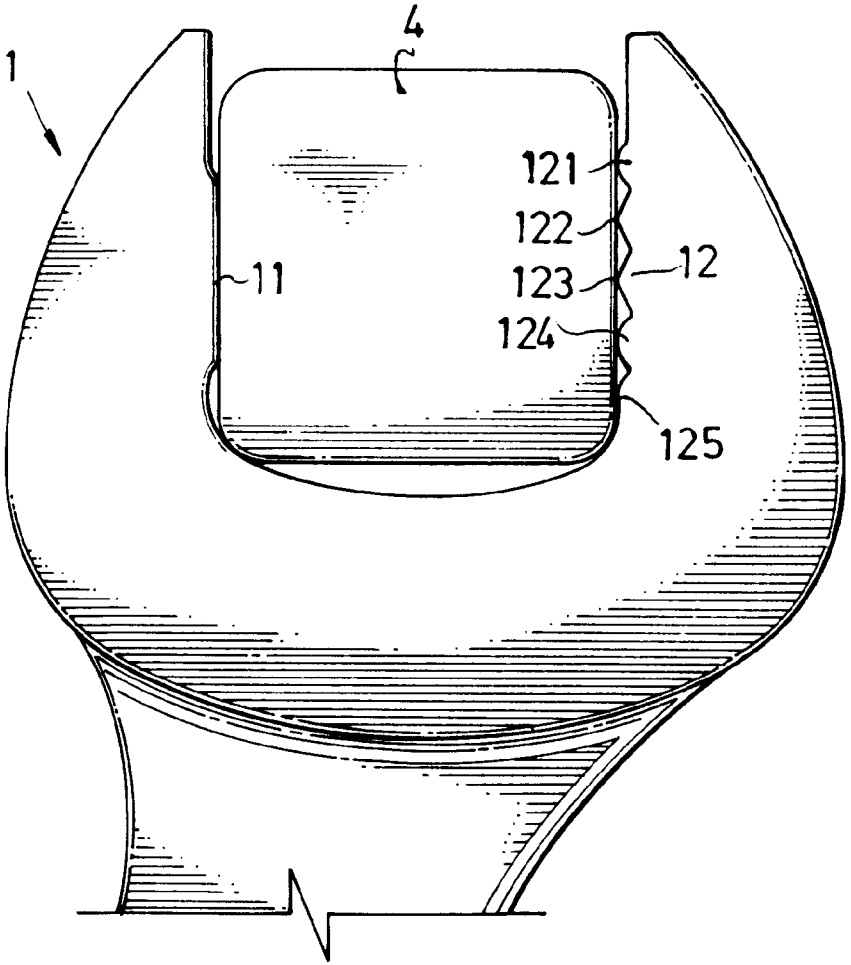
FIG. 17 shows the open end wrench grasped on a normal square head bolt according to the present invention.
Figure 18:
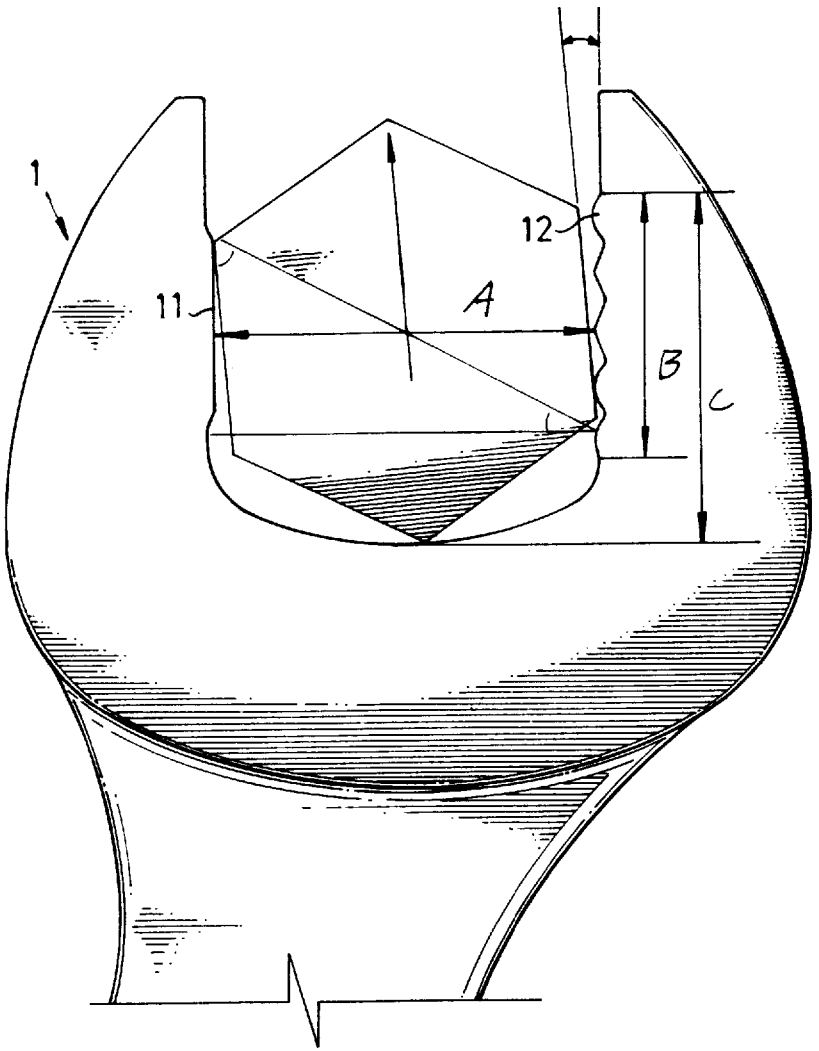
FIG. 18 shows the relationship between the open end wrench and the hexagon head bolt to be turned.
Figure 19:
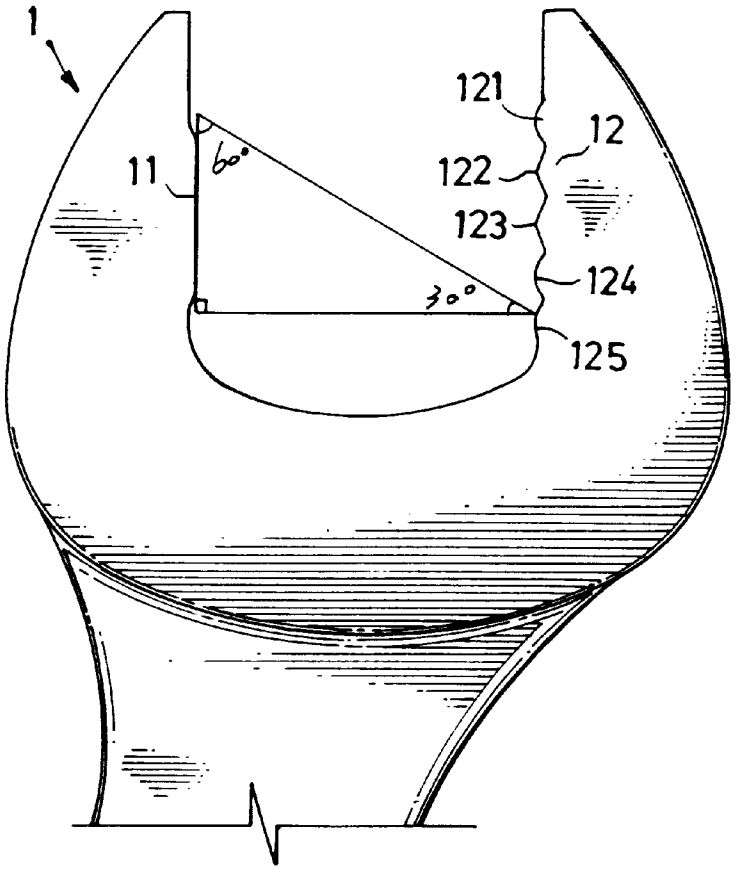
FIG. 19 is a schematic drawing explaining the design of the open end wrench according to the present invention.

Referring to FIGS. from 14 to 16, the open end comprises a flat raised portion 11 and a longitudinal series of teeth 12 respectively raised from the jaws inside the mouth. The length of the flat raised portion 11 is equal to the distance between the mid point of the first tooth 125 of the longitudinal series of teeth and the midpoint of the last tooth 121 thereof. The total length B of the longitudinal series of teeth 12 is equal to 0.67 of the width A of the mouth. The distance C from the remote end of the longitudinal series of teeth 12 to the nest is 0.91 of the width A of the mouth between the teeth. The number of the longitudinal series of teeth 12 is an odd number. When counting from the end adjacent to the nest toward the end remote from the nest, the first tooth 125 and second tooth 124 of the longitudinal series of teeth 12 have a respective smoothly curved peak for grasping normal square head bolts and square nuts as well as normal hexagon head bolts and hexagon nuts. The third tooth 123 and the fourth tooth 122 are pointed teeth. The distance between the mid point of the flat raised portion 11 and the third tooth 123 of the longitudinal series of teeth 12 is equal to the width of the mouth. Therefore, the third tooth 123 and the fourth tooth 122 are practical for grasping and turning worn-out bolts and nuts. The fifth tooth 121 is practical for grasping and turning normal hexagon head bolts and hexagon nuts as well as normal square head bolts and square nuts in the reversed direction. FIG. 15 shows the open end wrench grasped on a hexagon head bolt 3. FIG. 16 shows the open end wrench grasped on a worn-out bolt. FIG. 17 shows the open end wrench grasped on a square head bolt 4.

Figure 20:
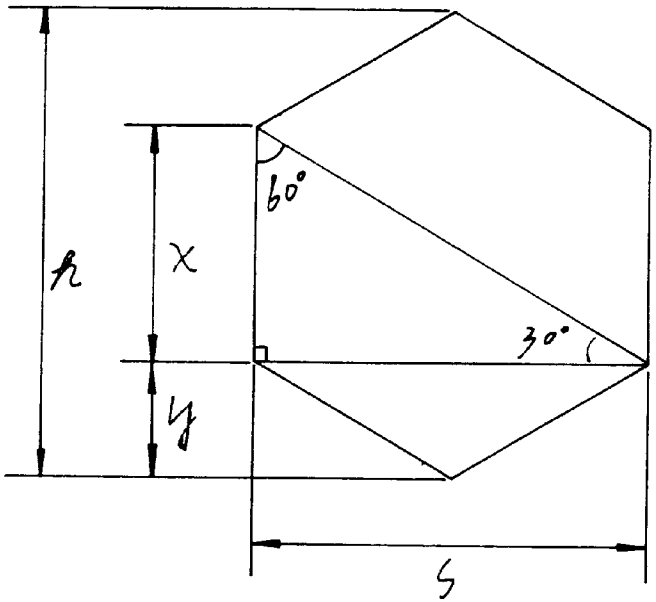
FIG. 20 is a schematic drawing explaining measurements used in the present invention.

Referring to FIGS. from 18 to 20 when turning a normal hexagon head bolt 3, the maximum torque angle is θ 1, the minimum torque angle is θ 2. Given that the width of a polygonal head bolt is "S" as shown in FIG. 20, the maximum turnable polygonal head bolt size is S1, the minimum turnable polygonal head bolt size is S2. Further, the distance between two diagonal angles of the polygonal head 3 is h. From the data provided it is obtained that:

$S=h * COS30°$ . . . normal polygonal head bolt $y=h-x/2$ $x=h * COS60°=1/2\ h$ $C1=x+y=h\ COS60°+h-h\ COS60°/2=h/2+h/2\ COS60°=3/4\ h^2$ d1=75% round off $d1=2rl=2(0.125\ h+0.875\ S)$ $A=d1\ COSP$ $W1=d1 \sin \alpha$

I claim:

1. An open end wrench comprising two jaws, a nest connected between said jaws, and a mouth defined within said jaws and said nest, a flat raised portion and a longitudinal series of five teeth respectively raised from said jaws inside said mouth for grasping and turning polygonal head bolts and nuts, wherein a length of said flat raised portion is equal to the distance between a midpoint of the first tooth of said longitudinal series of five teeth and a midpoint of the last tooth thereof, a total length of said longitudinal series of five teeth being equal to 0.67 of a width of said mouth, a distance from the remote end of said longitudinal series of teeth to said nest being 0.91 of the width of said mouth; the first tooth and the second of said longitudinal series of five teeth, when counting from an end adjacent to said nest toward an end remote from said nest, having a respective smoothly curved peak for grasping normal square head bolts and square nuts and normal hexagon head bolts and hexagon nuts; the third tooth and the fourth tooth of said longitudinal series of five teeth being pointed teeth, a distance between a midpoint of said flat raised portion and the third tooth of said longitudinal series of five teeth being equal to the width of said mouth, the fifth tooth of said longitudinal series of five teeth being for turning hexagon head bolts, hexagon nuts, square head bolts and square nuts in the reversed direction.

* * * * *